US012310445B2

(12) United States Patent
Kyle

(10) Patent No.: US 12,310,445 B2
(45) Date of Patent: May 27, 2025

(54) SHOE DEVICE WITH DUAL STADIUM ARCH BIMODAL STRUCTURE FOR RAPID ENTRY AND RELEASE

(71) Applicant: Kentigern S Kyle, Naples, FL (US)

(72) Inventor: Kentigern S Kyle, Naples, FL (US)

( * ) Notice: Subject to any disclaimer, the term of this patent is extended or adjusted under 35 U.S.C. 154(b) by 0 days.

(21) Appl. No.: 18/224,109

(22) Filed: Jul. 20, 2023

(65) Prior Publication Data

US 2023/0363489 A1 Nov. 16, 2023

Related U.S. Application Data

(63) Continuation-in-part of application No. 17/208,326, filed on Mar. 22, 2021, now Pat. No. 11,564,442, which is a continuation-in-part of application No. 16/120,899, filed on Sep. 4, 2018, now Pat. No. 11,000,091.

(60) Provisional application No. 62/694,484, filed on Jul. 6, 2018, provisional application No. 62/553,326, filed on Sep. 1, 2017.

(51) Int. Cl.
*A43B 11/00* (2006.01)

(52) U.S. Cl.
CPC ..... *A43B 11/00* (2013.01)

(58) Field of Classification Search
CPC ..... A43B 11/00; A43B 2/0052; A43B 2/248; A43B 2/12; A43B 2/126
See application file for complete search history.

(56) References Cited

U.S. PATENT DOCUMENTS

| | | | | |
|---|---|---|---|---|
| 2,481,281 | A * | 9/1949 | Bender | A43B 3/126 D2/916 |
| 2008/0189984 | A1* | 8/2008 | Januszewski | A43B 3/242 36/11.5 |
| 2020/0390183 | A1* | 12/2020 | Arnold | A43B 3/242 |
| 2021/0068498 | A1* | 3/2021 | Cheney | A43B 11/00 |
| 2021/0145114 | A1* | 5/2021 | Kyle | A43B 21/26 |
| 2022/0361627 | A1* | 11/2022 | Cheney | A43B 3/126 |
| 2023/0301394 | A1* | 9/2023 | Cristobal | A43B 3/242 |

* cited by examiner

*Primary Examiner* — Ted Kavanaugh
(74) *Attorney, Agent, or Firm* — Bryan L. Loeffler, Esq.; Loeffler IP Group, P.A.

(57) ABSTRACT

A shoe device having a bimodal structure, configured to selectively snap the device to at least one of a second position and a first position, which selectively snaps the shoe into a first position upon being subjected to a first bending force, apt for placement or removal of a foot, and selectively snaps the shoe into a second position upon being subjected to a second bending force, apt for securement of a foot or having no foot. A flexible mid stadium arch structure, with an apex forming a heel notch mechanism, connects to a footbed and sole. A flexible rear stadium arch structure, with an apex forming a shoe collar mechanism, connects to a footbed and sole. The arches can be inverted upon assembly for greater functionality.

10 Claims, 12 Drawing Sheets

SHOE DEVICE WITH DUAL STADIUM ARCH BIMODAL STRUCTURE FOR RAPID ENTRY AND RELEASE

CROSS-REFERENCE TO RELATED APPLICATIONS

This application is a continuation-in-part of U.S. Non-provisional patent application Ser. No. 17/208,326 filed Mar. 22, 2021, and parent U.S. Non-provisional patent application Ser. No. 16/120,899, filed Sep. 4, 2018, and claims the benefit of U.S. Provisional Patent Application Ser. No. 62/694,484, filed Jul. 6, 2018, and U.S. Provisional Patent Application Ser. No. 62/553,326 filed Sep. 4, 2017, which by reference are incorporated herein in their entirety.

FIELD OF THE INVENTION

The present disclosure is generally directed to shoes, and more particularly to a bimodal shoe or sandal, or other foot related mechanical device, that allows a user to conveniently don and doff a shoe or device in fast or hands-free fashion.

BACKGROUND OF THE INVENTION

It is common for individuals to wear shoes to protect the feet. A shoe usually has a fastening arrangement that allows a user to fasten the shoe to their foot. For example, such fastening arrangements may include straps, shoelaces, hook-and-loop material, zippers and other fastening systems.

However, existing shoes are problematic because their fastening arrangements can require bending, stooping or sitting down, the use of fingers or hands, or are complicated, cumbersome or aesthetically unpleasing, or the fastening mechanism, due to their complexity of design, requires materials and labor as to not permit mass or low-cost production.

Other types of shoes have evolved that have no straps or fastening devices, and thus permit rapid donning without stooping or bending down, such as flip flops, sandals, or clogs. However, these shoe designs lack securing systems of the back heel and do not provide the necessary stability to the foot to permit proper foot safety use with running or active use. Further, these designs are often cited for causing numerous injuries and falls.

Other types of shoes have evolved that are designed to be quicker and easier to don on and off, with minimal use of hands, without sitting or bending down to fasten or unfasten the shoe. However, these designs utilize complicated and inefficient snaps, wheels, ratchets, magnets, mainsprings, pulleys, electric motors, common structures with loops and connection points, pivoting or movable straps with support brackets, collapsible structures in the heel counter, pivot mechanisms attaching the outer counter to the sole, flexible cloth materials at the forefoot, stiffened cloth materials at the heel cup, or a combination of these mechanism or materials that by their complexity of material or design do not permit mass or low cost production.

Other types of rapid entry shoes have evolved that utilize a spring-like heel counter or a stiff shoehorn heel counter combined with flexible cloth or mesh shoe collars and uppers that are designed to be quicker and easier to don on and off, with minimal use of hands, without sitting or bending down to fasten or unfasten the shoe. However, these designs do not provide a sufficiently secure fit at the forefoot, or higher, apt for rugged use and athletic activity.

Therefore there exists a need for an improved shoe that is quick and easy to don on and don off, with minimal use of hands, without sitting or bending down to fasten or unfasten the shoe, that permit the use of active motion such as running or active walking without possibility of injury or stumbling, that provide a secure fit at the forefoot, or higher, apt for rugged use and athletic activity, with a design permitting mass or low cost production.

SUMMARY OF THE INVENTION

This summary is provided to introduce a selection of concepts in a simplified form that are further described below in the detailed description. This summary is not intended to identify all key features or essential features of the claimed subject matter, nor is it intended to be used to limit the scope of the claimed subject matter. Furthermore, the claimed subject matter is not limited to implementations that solve any or all disadvantages noted in any part of this disclosure. The invention disclosed incorporates a multitude of concepts that some or all of which can combine to collectively solve the challenges as defined. These concepts and related features and elements as well as the operation of the disclosed embodiments will become more apparent considering the following description of various embodiments and accompanying drawings.

Disclosed is a bimodal shoe, defined as shoe device or other similar foot device that can incorporate the benefits of the designs defined below including but not restricted to structures such as shoes, boots, sandals, clogs, skis, snowboards, skates, skateboards, flippers, paddle board foot areas, or other similar structures, the bimodal shoe comprising a sole, a forward toe box area securing system, of various well known mechanisms as typical in the shoe industry, such as a foot strap, toe strap, slide upper, clog upper, sneaker upper, boot upper, or similar, and a bimodal structure, the bimodal structure comprising dual bimodal stadium arch structures, the bimodal structure configured to selectively snap to a first position and a second position, wherein the bimodal structure has incorporated positions, either or both positions with stored kinetic potential (e.g. elastic potential energy), wherein the bimodal structure utilizes the tensile properties of materials shaped in spherical, curved, or semi-spherical forms, wherein the forms can be changed from one position to the other by directional force from multiple sides (e.g. vertical or lateral forces directed to pressure points), wherein directional force is applied to pressure points causing the structure to change positions upon a threshold directional force being applied.

In one aspect, the bimodal structure can be activated to snap into the first position causing an opening of the bimodal shoe formed by the top line, shoe collar or collar wall to change for receiving or removing a foot in the bimodal shoe.

In another aspect, causing the bimodal structure to snap into the second position causes an opening of the bimodal shoe formed by the top line, collar, or collar wall to change for securing a foot received in the bimodal shoe.

In another aspect, causing the bimodal structure to snap into the first position causes a heel counter of the shoe to pivot.

In another aspect, causing the bimodal structure to snap into the first position causes a heel counter to deform.

In another aspect, the bimodal structure is curved in at least one of the second position and the first position.

In another aspect, the bimodal structure is located at or in the sole of the bimodal shoe.

In another aspect, the bimodal structure is located at a heel counter of the bimodal shoe.

In another aspect, the bimodal structure is located at a sole of the bimodal shoe such that stepping in the shoe with a user's foot while the bimodal structure is in the second position causes the bimodal structure to snap into the first position.

In another aspect, the bimodal structure is located at a sole of the bimodal shoe such that removing the user's foot from the shoe while the bimodal structure is in the first position causes the bimodal structure to snap into the second position.

In another aspect, mechanisms permit directional force to be applied in a hands free fashion to pressure points required to activate the bimodal structure comprised of, a heel counter based pivot system that changes downward pressure on a heel tab into upward pressure to a shoe collar based bimodal structure at its activation pressure point, a rear sole or flared heel based system that changes downward pressure on the heel tab into pressure to the bimodal structure at its activation pressure point.

In another aspect, the bimodal structure of the heel counter variations contains two side arms or bands that separate and cause the heel notch and shoe opening to become larger for receiving a foot and vice-versa.

In another aspect, the bimodal shoe contains a back tab or shape that forms part of a lever, that by using the back sole and heel portion in connected fashion, creates a lever converting downward pressure on the tab or shape into upward pressure to the singular pressure point that can activate the bimodal structure.

In another aspect, the bimodal shoe contains a back sole area that rises upwards behind the heel counter, converting downward pressure on the back tab or shape into upward focused pressure to the singular pressure point that can activate the bimodal structure.

In another aspect, flexible areas of the body of the shoe or shoe-like structure traverse from a narrower portion of the shoe to a wider portion of the shoe, such that when the bimodal structure is activated the opening of the shoe is increased or decreased.

In another aspect, a heel counter variation includes two side arms that separate and cause the heel notch or shoe opening to become larger for receiving a foot and vice-versa when the bimodal structure moves to the first position.

In another aspect, the heel counter may contain a separation between the bimodal structure forming a heel counter and a sole area below.

In another aspect, the shoe can incorporate one or a combination of bimodal structures depending on the desired functionality, design, and aesthetics of the bimodal shoe.

In another aspect, the bimodal structure contains a stadium arch.

In another aspect, the stadium arch comprises two side arm bands and a connecting flexible band at the apex in the shape of a curved arch, forming a heel tab, the side arm bands manufactured as a generally tubal or thick band-like strap, with a cross section demonstrating a range of shapes including a circle, oval, square, rectangular and the plurality of shapes between these cited, being vertical or forward-leaning as manufactured, relative to the plane of the horizontal sole, a curved, symmetrical structure spanning laterally the central portion of a shoe, connected to the sides of a sole of a footwear device at anchor points at the mid or rear region of a shoe via a clasp, grommet, other connecting device, or formed as one structure, the upper portion exhibiting in some sections a quarter moon or half circle-shaped cross-section profile, with a slight degree of inward concavity directed towards the longitudinal center line of the shoe, the arch being a flexible, vertically inclined stadium arch with known mechanical properties, forming a mid stadium arch.

In another aspect, the stadium arch comprises two side arm bands and a connecting flexible band in the shape of a curved arch at the apex, forming a front shoe collar area, manufactured as a generally tubal, or thick band-like strap, the side arm bands with a cross section demonstrating a range of shapes including a circle, oval, square, rectangular and the plurality of shapes between these cited, being vertical or forward-leaning as manufactured, relative to the plane of the horizontal sole, a curved, symmetrical structure spanning laterally the rear portion of a shoe, connected to the sides of a sole of a footwear device at anchor points at the rear region of a shoe via a clasp, grommet, other connecting device, or formed as one structure, the upper portion exhibiting in some sections a quarter moon or half circle-shaped cross-section profile, with a slight degree of inward concavity directed towards the longitudinal center line of the shoe, the arch being a flexible, vertically inclined stadium arch with known mechanical properties, forming a rear stadium arch.

In another aspect the bimodal structure of the shoe comprises the mid stadium arch at the mid section of the shoe, and the rear stadium arch at the rear section of a shoe.

In another aspect, the stadium arches, sole and other sections of the shoe may be manufactured of a material with tensile properties similar in nature to plastics, sheet metals, urethane and silicone rubbers, natural rubber, or Ethylene Vinyl Acetate or similar polymers, wherein portions can be changed from a stable position to an unstable position by directional force from different sides and directions, in which the form seeks to return to a native position due to inherent elastic and morphing properties. Alternatively, the stadium arches, sole and other sections of the shoe may be constructed of nonelastic elements but with added elastic elements. The form and shape of the arch is sized to the anatomical features of the end user's foot.

In another aspect, the top or apex of the mid stadium arch is shaped as to form a heel counter, in minimum utility a heel notch area, with a cross-section profile similar that of a half circle, as to create a slightly curved receiving area for the Achilles portion of a heel. In one embodiment, the mid stadium arch is manufactured such that an imaginary spinal line as reference point, being the line formed by the diameter line of the half circle at the apex point of the inner curved portion of the heel notch is approximately parallel to the sole, the side arm bands positioned approximately 90 degrees to the plane of the sole, representing the mid stadium arch's manufactured position.

In another aspect, the top or apex of the rear stadium arch is shaped as to form a shoe collar area, with a cross-section profile similar that of a half circle, as to create a slightly curved receiving area for the top and forefoot of a foot when a foot is entering, secured, or being removed from the shoe. In one embodiment, the rear stadium arch is manufactured such that an imaginary spinal line as reference point, being the line formed by the diameter line of the half circle at the apex point of the inner curved portion of the shoe collar is positioned approximately 45 degrees to the plane of sole as seen from the left side perspective view, the side arm bands positioned approximately 135 degrees to the plane of the sole as seen from the left side perspective view, representing the rear stadium arch's manufactured position.

In another aspect, the mid stadium arch is sized such that when rearward and downward vertical force is applied, for example during assembly, the heel notch section bends backward towards the rear of the shoe, forming the rear shoe top line of a foot insertion cavity, and at one point in its trajectory occupies the anatomically correct space at which it is positioned to envelope a lower portion of the Achilles, and the fleshy region of the heel above a rear portion of the Calcaneus, with an inserted and secured foot of a user of a typical footwear device, with the reference spinal line being approximately 135 degrees to the plane of horizontal sole as seen from the left side perspective view, forming a functional heel notch, as to secure a foot, representing the mid stadium arch's assembled position, with the bimodal structure in the second position.

In another aspect, the mid stadium arch is sized such that when rearward and downward vertical force is applied, for examples by a foot, the heel notch section occupies a backwardly position at the rear of the shoe and flared heel, and at this point in its trajectory occupies the space at the rear of the sole, with the lower lip of the heel notch section positioned at or near the top rear of the sole and flared heel, with the reference spinal line being approximately a 45 degree angle or less, relative to the plane of the sole as seen from the left side perspective view, forming a functional shoe horn device, representing the mid stadium arch's flexed position, with the bimodal structure in the first position.

In another aspect, the rear stadium arch is sized such that when forward and downward vertical force is applied, for example during assembly, the shoe collar section bends forward towards the front of the shoe, forming the forward shoe top line of a foot insertion cavity, and at one point in its trajectory occupies the anatomically correct space at which it is positioned to envelope and secure the top or forefoot of a foot, with an inserted and secured foot of a user of a typical footwear device, with the reference spinal line being approximately 60 degrees to the plane of horizontal sole as seen from the left side perspective view, forming a functional shoe collar, as to secure a foot, representing the rear stadium arch's assembled position, with the bimodal structure in the second position.

In another aspect, the rear stadium arch is sized such that when forward and downward vertical force is applied, for example by a foot, the shoe collar section occupies a forwardly position at the front of the shoe, and at this point in its trajectory occupies the space at the forward section of the shoe, apt for receiving an inserted foot, with the lower lip of the shoe collar section positioned at the space typically occupied by the top portion of the foot above the cuneiform bone region as a foot is being inserted into the shoe cavity, with the reference spinal line being approximately at 80 degrees relative to the plane of the sole as seen from the left side perspective view, forming the forward opening of the shoe cavity, representing the rear stadium arch's flexed position, with the bimodal structure in the first position.

In another aspect, the shoe is assembled with the mid stadium arch and the rear stadium arch pulled in inverted fashion, the mid stadium arch passing over and rearward of the rear stadium arch, providing tension to the stadium arches, allowing said structures to move between a first closed position, a second, flexed, open position, and a plurality of heel and forefoot embracing positions.

In another aspect, the shoe is assembled with the mid stadium arch and the rear stadium arch pulled in inverted fashion, the mid stadium arch passing below and rearward of the rear stadium arch, providing tension to the stadium arches, allowing said structures to move between a first closed position, a second, flexed, open position, and a plurality of heel and forefoot embracing positions.

In an embodiment of the shoe, the heel notch of the mid stadium arch is anchored to the rearward part of the sole below the heel tab in its assembled position with a connecting strap, string, cable, chain, rope, lines, or a strap-like portion thereof anchored to the sole with a clasp, bolt, grommet, or other connecting device, as to position the mid stadium arch to form a functional heel notch to secure a heel.

In an embodiment of the shoe, the mid stadium arch is anchored to two opposite sides at the rear portion of the sole, rearward of the mid-sole, below the heel tab in its assembled position with connecting straps, strings, cables, chains, ropes, lines, or strap-like portions thereof anchored to the sole with clasps, bolts, grommets, or other connecting device, as to position the mid stadium arch to form a functional heel notch to secure a heel.

In an embodiment of the shoe, the mid stadium arch, during assembly, is pulled back towards the rear of the sole to its assembled position, over and above the rear stadium arch, and the left side of the mid stadium arch is connected to the left side of the rear stadium arch, and the right side of the mid stadium arch is connected to the right side of the rear stadium arch, with snap, button, claps, peg and hole, or other affixing device, to form the bimodal structure of the assembled shoe, as to position the mid stadium arch to form a functional heel notch to secure a heel.

In an embodiment of the shoe, the mid stadium arch, during assembly, is pulled back towards the rear of the sole to its assembled position, under and below the rear stadium arch, and the left side of the mid stadium arch is connected to the left side of the rear stadium arch, and the right side of the mid stadium arch is connected to the right side of the rear stadium arch, with snap, button, claps, peg and hole, or other affixing device, to form the bimodal structure of the assembled shoe, as to position the mid stadium arch to form a functional heel notch to secure a heel.

In an embodiment of the shoe, the upper portion of the dual side arm bands of the rear stadium arch connecting the side arms to the shoe collar area are formed as outwardly curved "C" shape, inwardly curved "C" shaped, "Z" shaped, "S" shaped, "V" shaped, "L" shaped, or "O" shaped elongating sections of the side arm bands of each side below the shoe collar region, forming an elongating section, the elongating section presenting greater flexibility and capacity for forward motion, sized as to increase a more forward position of the shoe collar to the front of the shoe, due to an increased radial range of the top of the rear stadium arch, as seen from the side perspective, with the bases of the rear stadium arch at the sole being the fulcrum points, than if the rear stadium arch had no elongating section.

In an embodiment of the shoe, the rear stadium arch comprises outwardly curved "C" shape notched sections of the side arm bands of each side below the shoe collar region, forming the upper blocking sections, sized as to occupy a space larger and above the assembled mid stadium arch side arm bands, connecting the shoe collar section to the vertical side arm bands, with the outermost portion of the blocking sections being farther away from the central axle line of the shoe. During assembly, the mid stadium arch is pulled back over and above the rear stadium arch, to its assembled position, and the left side arm band of the mid stadium arch is restricted to reverting to its native position by the left side blocking section of rear stadium arch, and the right side arm band of the mid stadium arch is restricted to reverting to its native position by the right side blocking section of rear stadium arch, the mid and rear stadium arches in this assembled positions representing a bimodal structure of the shoe, as to position the mid stadium arch to form a functional heel notch to secure a heel.

In an embodiment of the shoe, the rear stadium arch comprises outwardly curved "C" shape notched sections of the side arm bands of each side above the sole region, forming the lower blocking sections, connecting the sole to the vertical side arm bands, with the outermost portion of the blocking sections being farther away from the central axle line of the shoe. During assembly, the mid stadium arch is pulled back over and above the rear stadium arch, to its assembled position, with the side arm bands of the mid stadium arch positioned above the lower blocking sections. In the first position, the left side arm band of the mid stadium arch is restricted from a downward position and positioned further from the central point of the shoe due to the left lower blocking section, and the right side arm band of the mid stadium arch is restricted from a downward position and positioned further from the central point of the shoe due to the right lower blocking section, and the increased tension on both side arm bands of the mid stadium arch causing the mid stadium arch to revert from the second position to the first position when the foot is fully placed within the shoe.

In the preferred embodiment of the shoe, the rear stadium arch comprises the upper blocking sections and the lower blocking sections. The upper blocking sections and the lower blocking sections are spaced above and below the thinner mid-sections of the side arm bands, as to permit a range of vertical movement of the mid stadium arch moving along these thinner mid-sections of the side arm bands of the rear stadium arch of the rear stadium arch, with the uppermost range of the motion representing the location of the mid stadium arch with the shoe in the second position, and lowermost range of motion representing the location of the mid stadium arch in the first position. During assembly, the mid stadium arch is pulled back over and above the rear stadium arch, past the upper curvatures and above the lower curvatures, to its assembled second position.

In another aspect, the mid and rear stadium arches incorporate a mechanism to regulate and adjust their size, such as shoe laces, a bar and prong buckle, ring buckle, loop, slide bar buckle, cord locks, cord wheels, hook and loop strap, cam buckle, pressure spring snap, or other device of similar mechanical properties, which may be placed at the side arm bands, heel notch or shoe collar region.

In another aspect, disclosed mechanisms, being the insertion of a foot or the pressure from another foot, permit downward force to the mid stadium arch forming the upper heel notch in its assembled position, and concurrent forward force to the shoe collar section of the rear stadium arch in its assembled position, representing a lowered position of the heel notch and a forward position of the shoe collar in their trajectories to the bimodal structure's flexed position, causing: an enlarged opening of foot insertion cavity of the bimodal shoe for receiving or removing a foot in the bimodal shoe, representing the first or open position pf the shoe.

In another aspect disclosed mechanisms, being no foot inserted, or, a foot fully inserted in the correct position for normal use of the shoe such as walking or running, permit upward movement of the heel notch returning to its assembled position, and concurrent rearward position of the shoe collar section of the rear stadium arch to its assembled position, representing the assembled position of the heel notch and shoe collar in their trajectories to the bimodal structure's assembled position, causing: a reduced opening of foot insertion cavity of the bimodal shoe for securing a foot in the shoe, or having no inserted foot, representing the second or closed position of the shoe.

In other words, when a shoe is being donned the lowered position of the heel notch of the mid stadium arch and the forward position of the shoe collar portion of the rear stadium arch permit an increase of stored tension of both stadium arches, such that with an inserted foot fully slid into the foot insertion cavity, being aided by the shoe horn aspect of the heel notch of the mid stadium arch, being aided by the elongated shoe collar portion of the rear stadium arch, the stadium arches revert to native positions of the first position of the assembled shoe, gripping the forefoot and heel of the foot, thus transitioning the shoe from a first position to a second position with a partially inserted foot, back to a second position with a fully inserted foot, and upon partial removal of a foot to the first positions, and to the second position upon full removal of the foot.

In another aspect of the various defined embodiments, areas of the body of the shoe present partial or fully formed shoe collar and heel tab, or partial or solid side walls and upper of EVA, mesh, cloth, rubber, leather, spandex, neoprene, synthetics and other standard shoe materials, encapsulating the principal fastening elements described herein including the mid stadium arch with heel notch, rear stadium arch with shoe collar portion, and connecting elements, permitting a wide range of styles and shoe types similar to the assembled position of the shoe using materials to duplicate the utility of the stadium arches, not representing a unique invention different to the species described herein.

These and other objects, features, and advantages of the present invention will become more readily apparent from the attached drawings and the detailed description of the preferred embodiments, which follow.

BRIEF DESCRIPTION OF THE DRAWINGS

The embodiments can be better understood with reference to the following drawings and description of a shoe for the left foot, understanding that a mirror image version for a right foot embodies the same descriptions, components, and mechanisms as illustrated below and described herein. The components in the figures are not necessarily to scale, emphasis instead being placed upon illustrating the principles of the embodiments. Moreover, in the figures, like reference numerals designate corresponding parts throughout the different views. The preferred embodiments of the invention will hereinafter be described in conjunction with the appended drawings provided to illustrate and not to limit the invention, where like designations denote like elements, and in which.

DESCRIPTION

Figure 1:
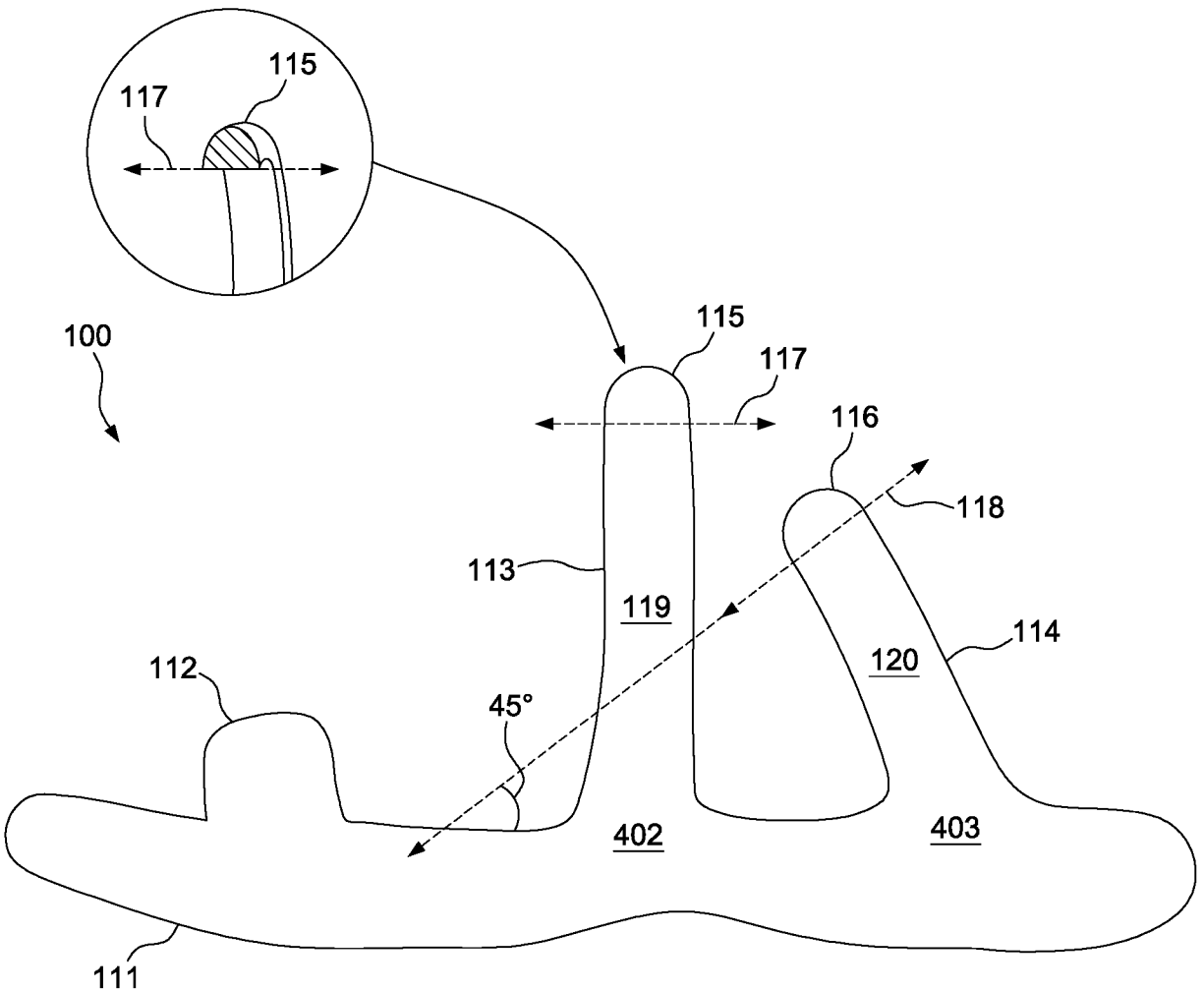
FIG. 1 presents a left side perspective view of a basic version of a bimodal shoe with a slide upper toe box fastening mechanism displayed for clarity, including dual stadium arches in manufactured form, with a conceptual illustration of approximate geometric angles of the heel notch spinal line and shoe collar spinal line relative to the sole, using commonly accepted principles of a circle wherein the whole circle is 360 degrees, and the angle which forms a straight line is an 180-degree angle, occupying a horizontal plane representing the base of the sole, in accordance with aspects of the present disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As shown throughout the figures, disclosed is a bimodal shoe 100. The bimodal shoe 100 comprising a sole 111, a toe box securing mechanism 112, and a bimodal structure 110 further comprising the combined stadium arch elements of a mid stadium arch 113 and a rear stadium arch 114. The bimodal structure 110 may be configured to selectively snap to a first position 124 and a second position 126.

It is to be understood, that the bimodal shoe 100 may be embodied as a sandal or any appropriate footwear.

As seen in FIGS. 1, 2*a*, 2*b*, 2*c*, 2*d*, 3, the drawings show a basic version of a bimodal shoe 100 comprising a sole 111, a toe box fastening mechanism 112, a mid stadium arch 113, and a rear stadium arch 114, with the dual side arm bands 119 of the mid stadium arch 113 anchored to the sole 111 at the mid stadium arch left anchor location 402 and mid stadium arch right anchor location 406, with the dual side arm bands 120 of the rear stadium arch 114 anchored to the sole 111 at the rear stadium arch left anchor location 403 and rear stadium arch right anchor location 407.

As seen in FIG. 1, the mid stadium arch 113 is manufactured with the heel notch 115 positioned such that a vertical cross section at the mid point would show the previously described imaginary spinal line 117 of the shoe collar 116 approximately parallel to the sole. The rear stadium arch 114 is manufactured with the shoe collar 116 positioned such that a vertical cross section at the mid point would show the previously described imaginary spinal line 118 of the heel tab 116 approximately 45 degrees to the sole.

Figure 2A:
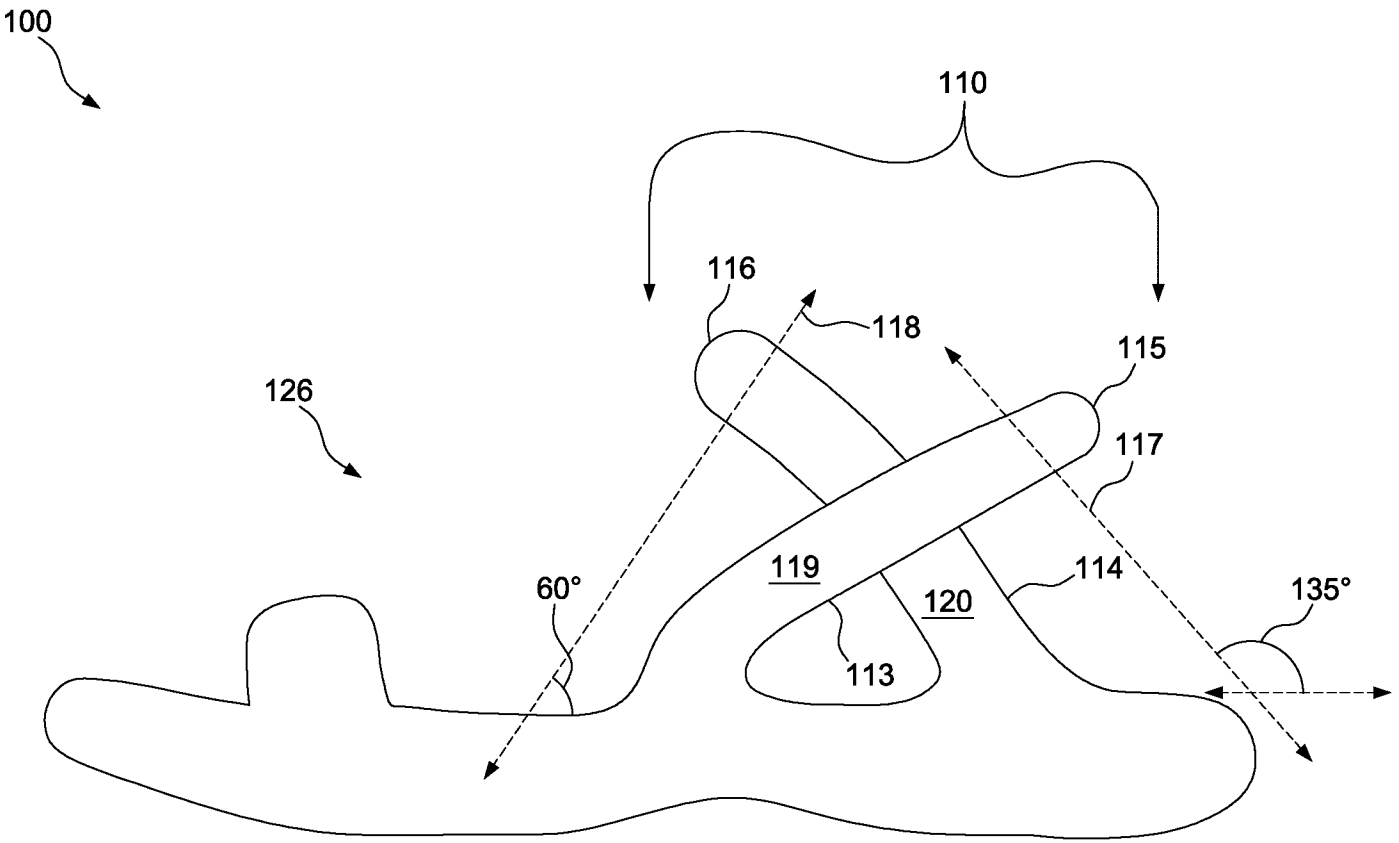
FIG. 2 presents a left side perspective view of the bimodal shoe of FIG. 1, including dual stadium arches in assembled form in the second position, with a conceptual illustration of approximate geometric angles of the heel notch spinal line and shoe collar spinal line relative to the sole, in accordance with aspects of the present disclosure.

As seen in FIG. 2*a*, a bimodal shoe 100 is assembled with applied force flexing the stadium arches into in a second position 126, with the mid stadium arch passing behind and above the rear stadium arch, as exhibited in drawings 2, 2*a*, 2*b*, 2*c*, 2*d*, 2*e*, or the mid stadium arch passing behind and below the rear stadium arch, as to form a bimodal structure 110 comprising the mid stadium arch 113, the rear stadium arch 114. As shown, the mid stadium arch 113 is assembled with the heel notch 115 positioned such that a vertical cross section of heel notch 115 at the mid point would show the previously described imaginary spinal line 117 approximately 135 degrees to the sole, and the rear stadium arch 114 is assembled with the shoe collar 116 positioned such that a vertical cross section at the mid point would show the previously described imaginary spinal line 118 of the shoe collar 116 approximately 60 degrees to the sole.

Figure 2B:
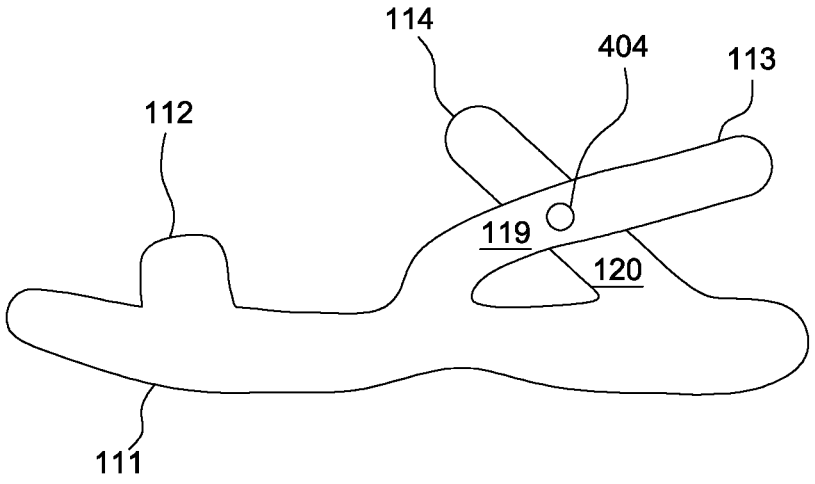

As seen in FIG. 2*b*, the bimodal shoe of FIG. 2 may have a fastening mechanism 404 such as a snap, pin, button, clasp, screw, bolt, wheel or other similar fastening mechanisms at the meeting points of the side arm bands of the mid and rear stadium arches in assembled position, to affix the left side of side arm bands 119 of the mid stadium arch to the left side of side arm bands 120 of the rear stadium arch, and the right side of side arm bands 119 of the mid stadium arch to the right side of side arm bands 120 of the rear stadium arch.

Figure 2C:
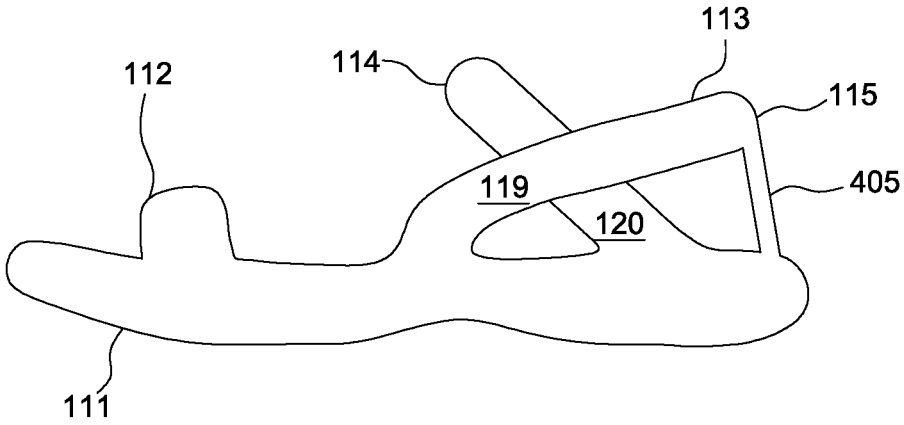

As seen in FIG. 2*c*, the bimodal shoe of FIG. 2 may have a fastening mechanism 405 such as a strap, tape, band, string, rope, or similar elongated fastening mechanism, or a similar mechanism formed of the same body and material as the sole, to cause the side arm bands of the mid and rear stadium arches to be positioned in the assembled position, connecting the heel tab of the mid stadium arch 115 to the rear of the sole 111.

Figure 2D:
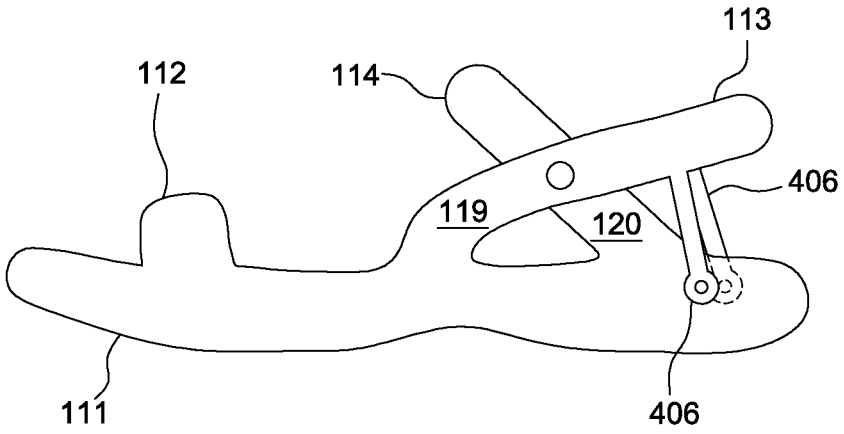

As seen in FIG. 2*d*, the bimodal shoe of FIG. 2 may have dual fastening mechanisms 406 such as a straps, tapes, bands, strings, ropes, or similar fastening mechanisms, or a similar mechanisms formed of the same body and material as the sole, to cause the side arm bands of the mid stadium arch 119 to be positioned in the assembled position, connecting the left arm of the mid stadium arch 113 to the left side of the rear sole 111, and the right arm of the mid stadium arch 113 to the right side of the rear sole 111.

Figure 3:
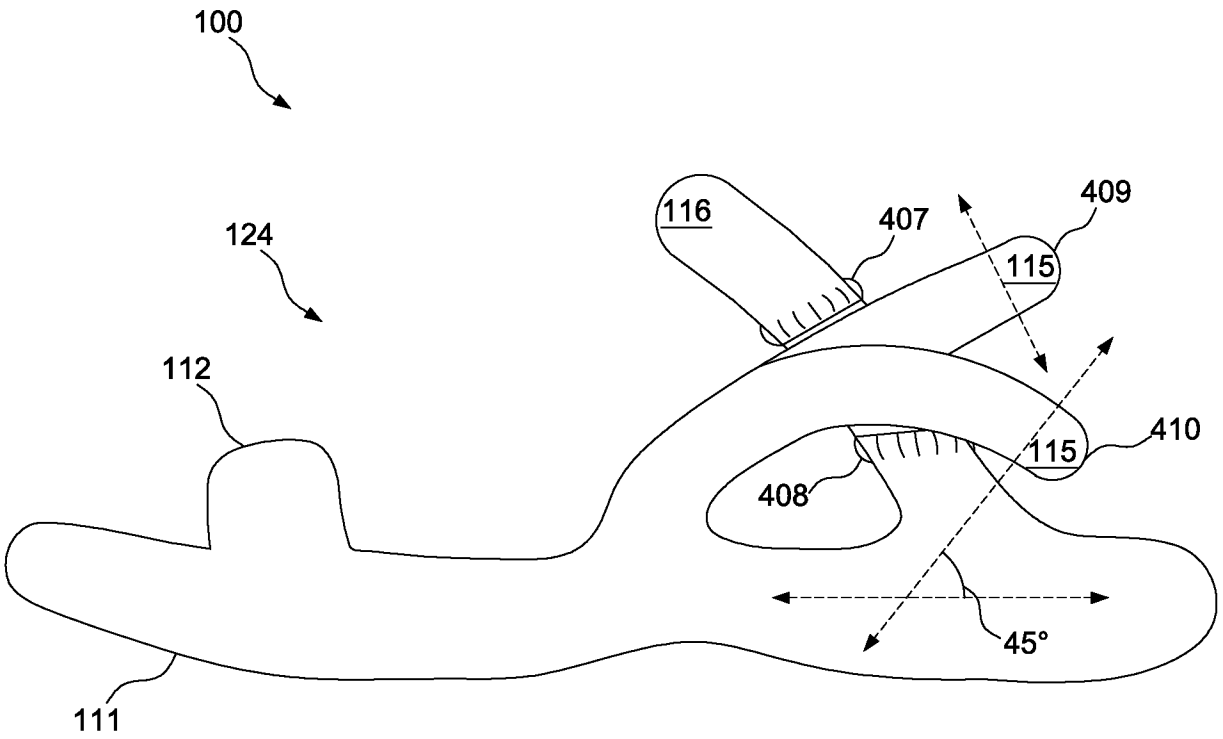
FIG. 3 presents a left side perspective view of a bimodal shoe of FIG. 1, including dual stadium arches in assembled form in the first position, with a conceptual illustration of approximate geometric angles of the heel notch spinal line and shoe collar spinal line relative to the sole, in accordance with aspects of the present disclosure.

As seen in FIG. 3, in a preferred embodiment, the mid stadium arch 113 passing behind and above the rear stadium arch 114, upper blocking sections 407 are positioned on the upper portion of side arm bands 120 of the rear stadium arch 114, as to restrict the movement of the mid stadium arch 113 higher than its placement in the second position 126 of the bimodal shoe, positioning the heel notch 115 at its highest permitted placement 409 with shoe 100 in its second position 126, and lower blocking sections 408 are positioned on the lower portion of side arm bands 120 of the rear stadium arch 114, as to restrict the movement of the mid stadium arch 113 lower than its placement in the first position 124 of the bimodal shoe, positioning the heel notch 115 at its lowest permitted placement 410 with shoe 100 in its second position 124. The highest permitted position 409 of the heel notch 115 demonstrates the correct placement of the heel notch 115 on the second position 126 to function as a heel notch, and the lowest permitted position 410 of the heel notch 115 demonstrates correct placement of the heel notch 115 in the first position 124 to function as a shoe horn, and the plurality of placements of the mid stadium arch 113 between position 409 and position 410 being the range of motion that morphs the shoe insertion cavity to permit donning or doffing of the shoe.

Figure 4:
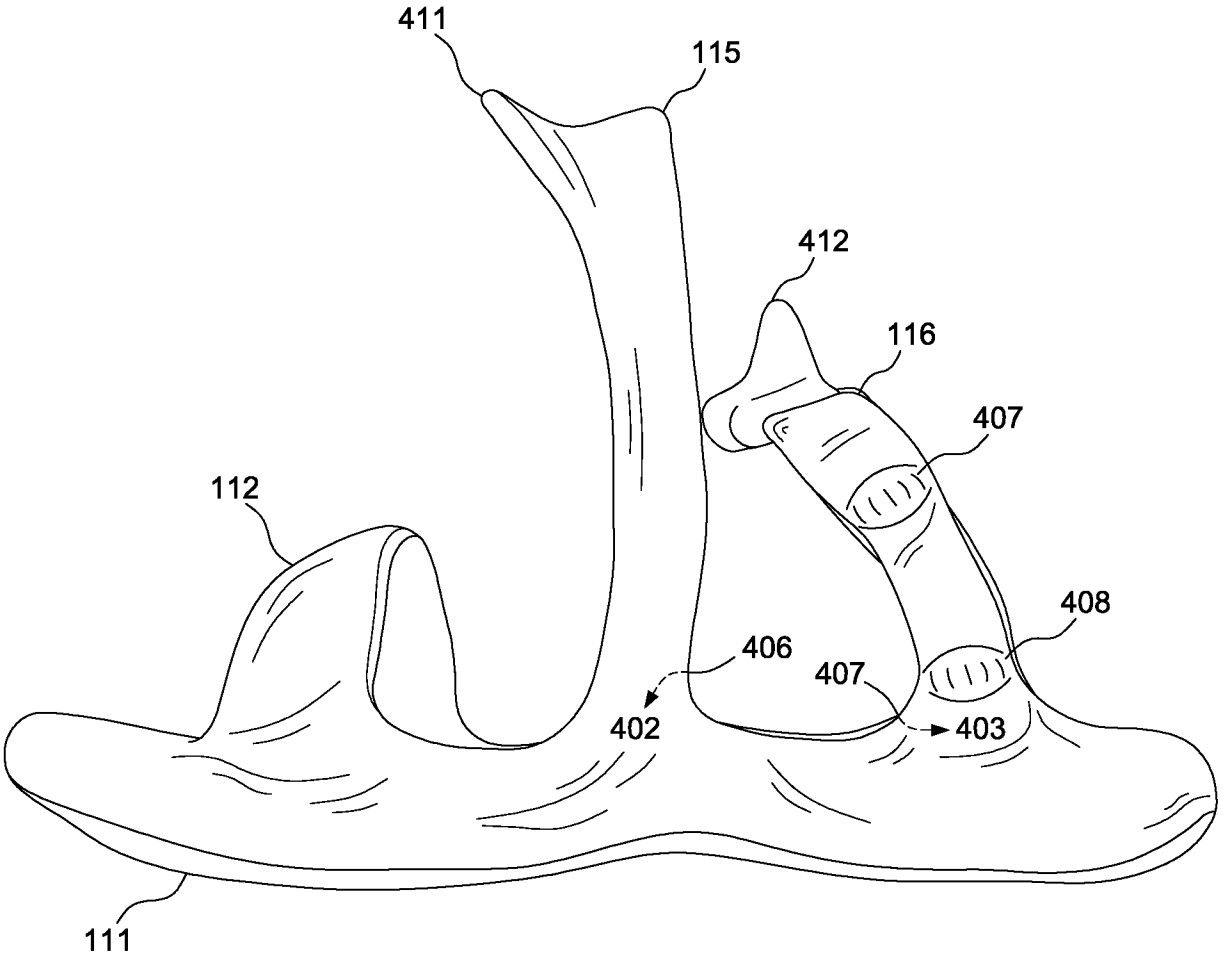
FIG. 4 presents a left side perspective view of an exemplary bimodal shoe including dual stadium arches in manufactured form, in accordance with aspects of the present disclosure.

As seen in FIG. 4, in the preferred embodiment of the shoe of FIG. 3, the elements 111, 112, and the elements of mid stadium arch 113 being anchor points 402 and 406, side arm bands 119, heel notch 115, and the elements of rear stadium arch 114 being anchor points 403 and 407, side arm bands 120, and shoe collar 116, with upper blocking points 407, and lower blocking points 408, may be manufactured as one piece, for example using materials such as EVA, rubber, foam, or other flexible material. The heel tab 115 is formed with a top similar to a rearward facing shoehorn 411, to further aid the entry of a foot. The shoe collar 116 is formed with a top similar to a rearward facing shoehorn 412, to further aid the entry of a foot.

Figure 5:
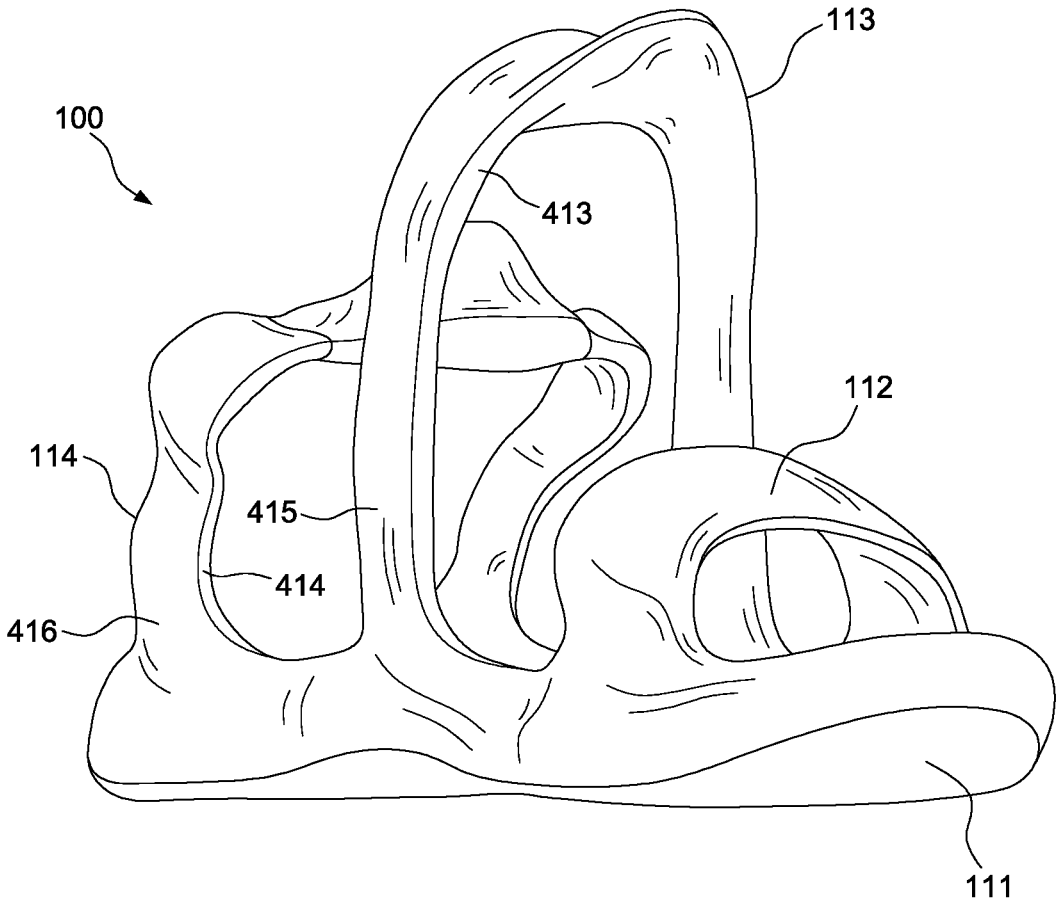
FIG. 5 presents a three quarter front perspective view of the exemplary bimodal shoe of FIG. 4, in manufactured form, in accordance with aspects of the present disclosure.

As seen in FIG. 5, in the preferred embodiment of the shoe of FIG. 3, the dual side arm bands of the mid stadium arch 113 are of a width 413 of between 5 mm and 10 mm, depending on the size of the shoe per the end user, and technical properties of the selected material. The length 415 of the dual side arm bands of the mid stadium arch 113 is approximately three times the width. The dual side arm bands of the rear stadium arch 114 are of a width 414 of approximately 3 mm to 7 mm, depending on the size of the shoe per the end user, and the technical properties of the selected material. The length 416 of the dual side arm bands of the rear stadium arch 114 is approximately four times the width.

Figure 6:
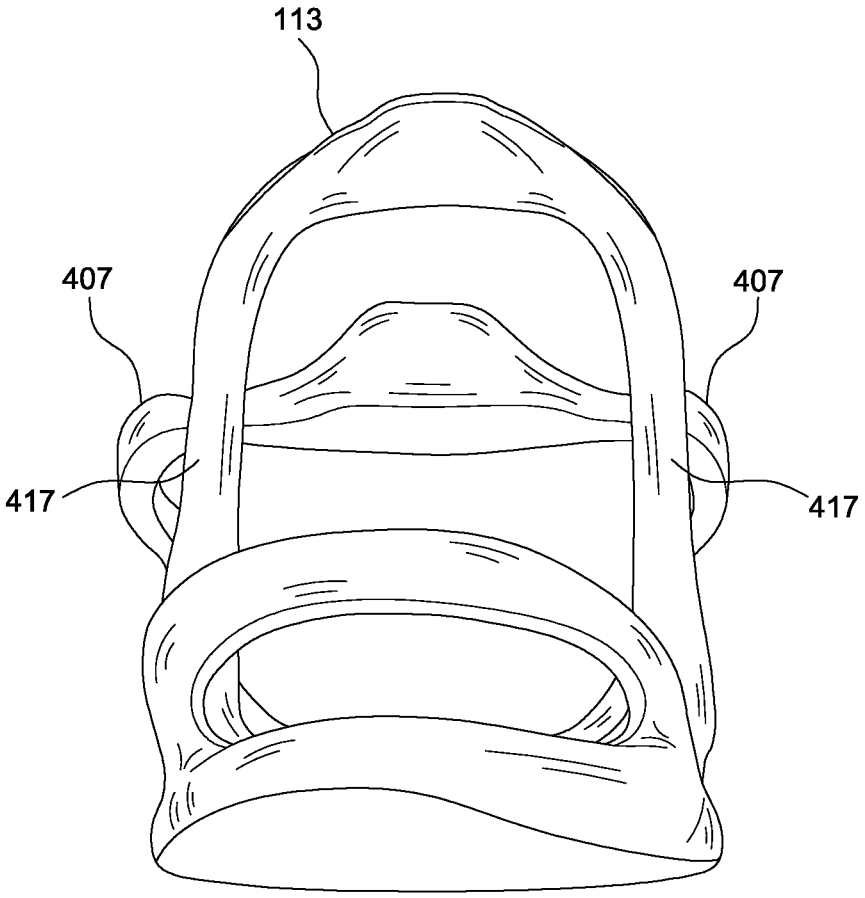
FIG. 6 presents a front perspective view of the exemplary bimodal shoe of FIG. 4, in manufactured form, in accordance with aspects of the present disclosure.

As seen in FIG. 6, in the preferred embodiment of the shoe of FIG. 3, the width as seen from the front perspective view of the mid stadium arch 113 as measured at the eventual point of overlap and convergence 417 with the rear stadium arch as assembled in the second position, is smaller than the width as seen from the front perspective view of the upper blocking sections 407. The total width of the upper blocking sections 407 and thickness 414 of the bands 120 forming the upper blocking sections 407 are sized as to create an open space approximately the required width of the foot insertion cavity based on the size of the end user's foot.

Figure 7:
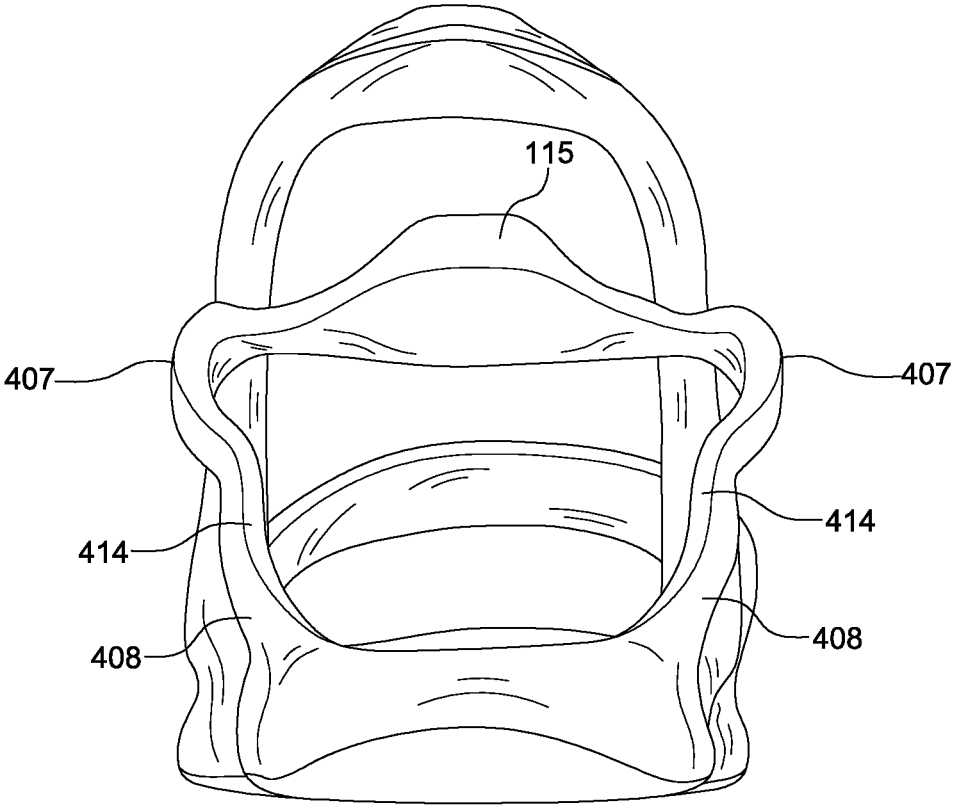
FIG. 7 presents a rear perspective view of the exemplary bimodal shoe of FIG. 4, in manufactured form, in accordance with aspects of the present disclosure.

As seen in FIG. 7, in the preferred embodiment of the shoe of FIG. 3, the width and length of the upper blocking sections 407 are sized, in accordance of the material of the shoe, such as a typical EVA or rubber material including technical properties of elongation of approximately 500 percent or more, and a shore hardness of approximately 85 or less, with a curved "C" shape representing an elongation section, as to permit forward flexibility of the upper portion of the rear stadium arch 114 including the shoe collar 116 upon applied forward force, spaced with a forward range of motion sufficient to permit the passing below of, and forward movement of, a foot including the cuneiform bone top region and transversal arch, upon donning or doffing of a foot of the assembled shoe, representing the bimodal motion of the rear stadium arch. The mid sections of the dual side arm bands 120 of the rear stadium arch 114 between the upper blocking sections 407 and lower blocking sections 408 present a construction closer to the mid section of the shoe, relative to the larger construction less close to the mid section of the shoe of blocking sections 407 and 408, presenting a space of less friction for, and permitting upward and downward motion of, the dual side arm bands 119 of the mid stadium arch 113, along the plurality of these positions as permitted below the upper blocking sections 407 and above the lower blocking sections 408, representing the bimodal motion of the mid stadium arch, upon donning or doffing of a foot of the assembled shoe.

Figure 8:
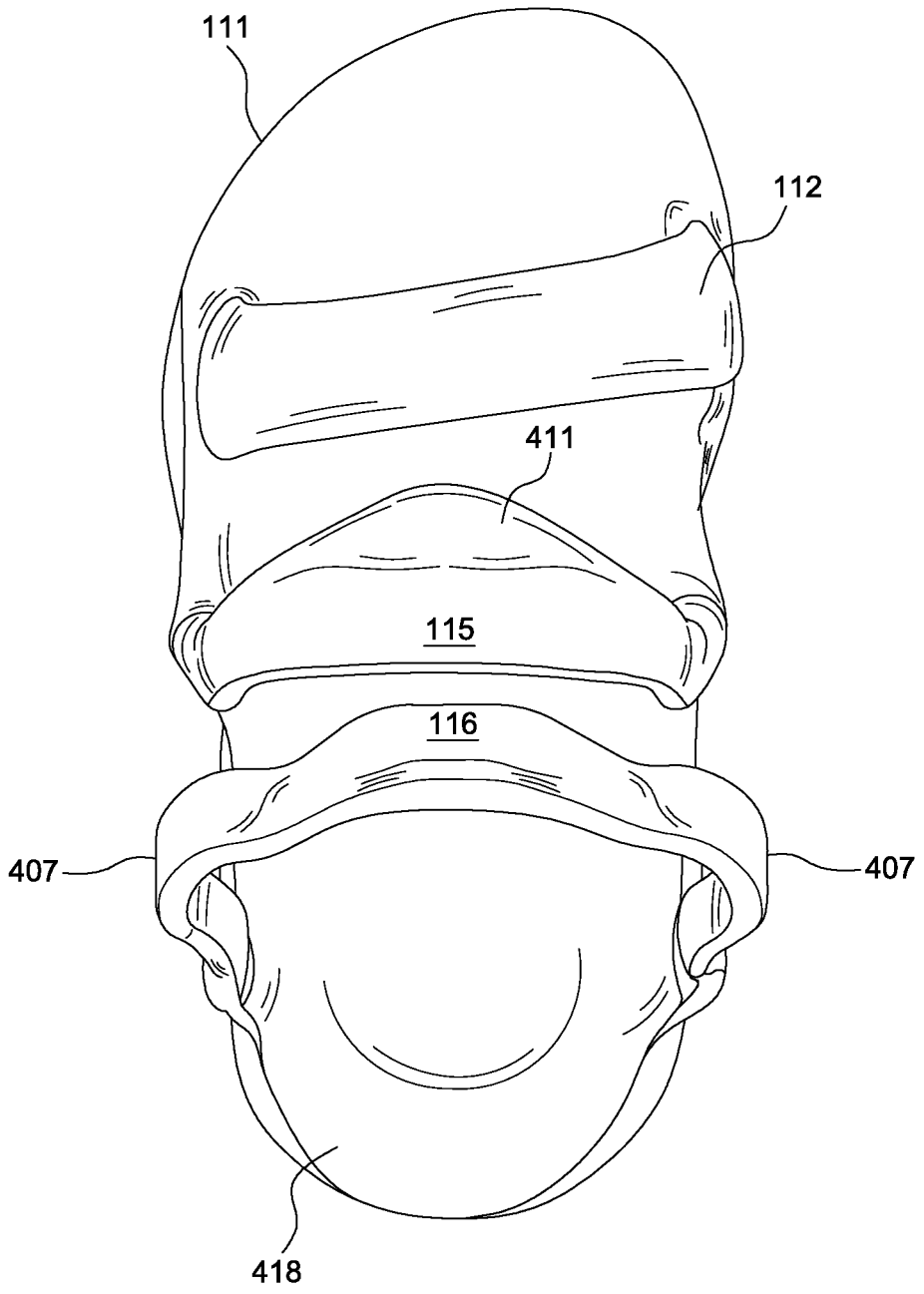
FIG. 8 presents a top perspective view of the exemplary bimodal shoe of FIG. 4, in manufactured form, in accordance with aspects of the present disclosure.

As seen in FIG. 8, in the preferred embodiment of the shoe of FIG. 3, the heel section 418 at the rear sole presents a curved mounded surface, of similar shape and proportion to the negative space surrounding the top of the heel notch 115 and shoehorn 411. The complementary reverse mirror shape of the heel section 418 presents a blocking mechanism to prevent further movement and rotation of the top of the heel notch 115 and shoehorn 411 with the shoe in the first, open position 124 in assembled form.

Figure 9:
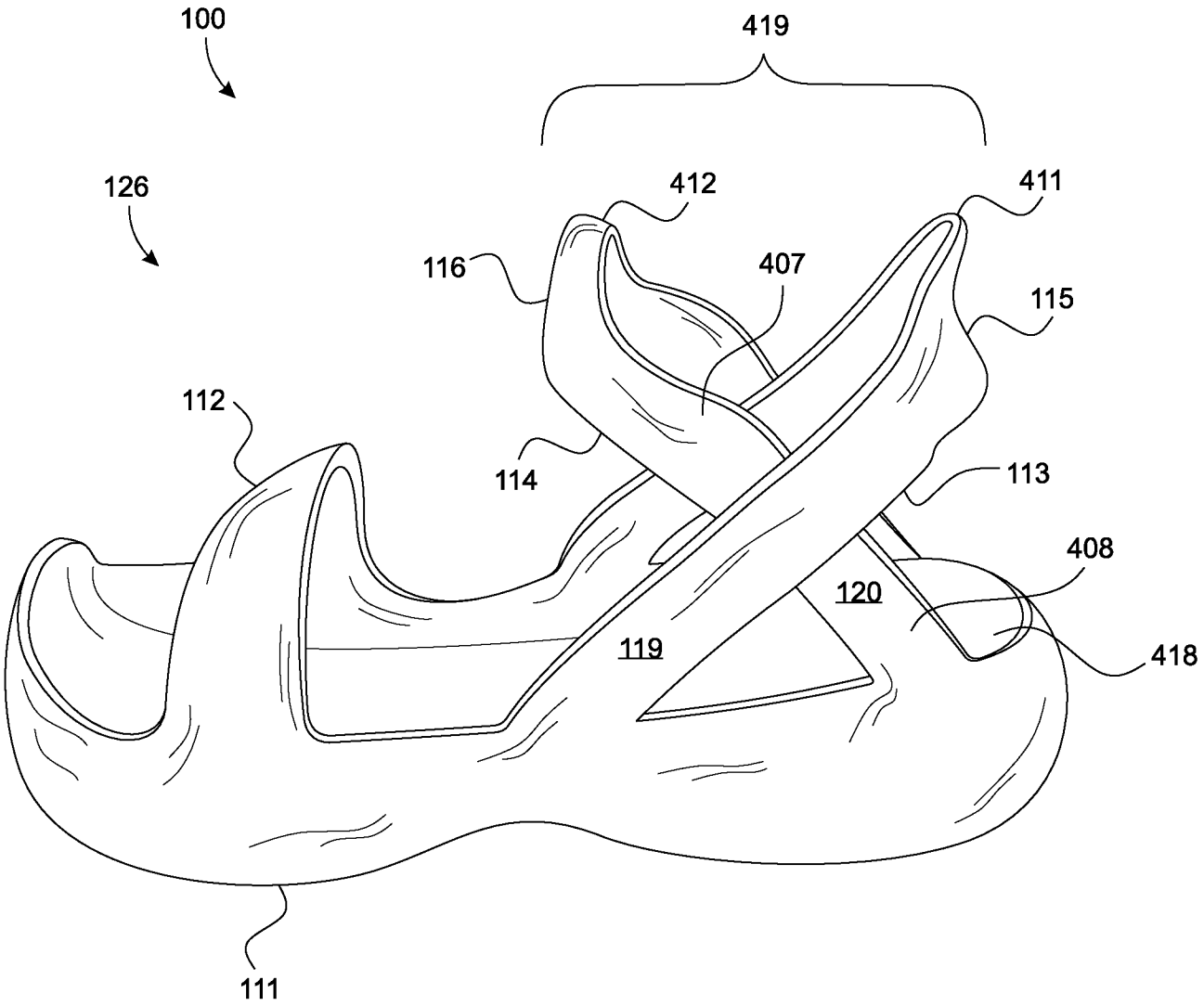
FIG. 9 presents a right side perspective view of the exemplary bimodal shoe of FIG. 4, where the shoe is positioned in the closed second position, in assembled form, with the upper portions of the mid stadium arch positioned rearward relative to the rear stadium arch, in accordance with aspects of the present disclosure.

As seen in FIG. 9, the preferred embodiment of the shoe of FIG. 3 is presented in assembled form with the mid stadium arch 113 pulled back and over the rear stadium arch 114, in the closed second position 126, forming the opening cavity 419 for the insertion of a foot formed by the heel notch 115, heel notch lip 411, upper portions of the dual side arm bands 119 of the mid stadium arch 113, and the shoe collar 116, shoe collar lip 412, and upper portions of the dual side arm bands of the rear stadium arch 114.

Figure 10:
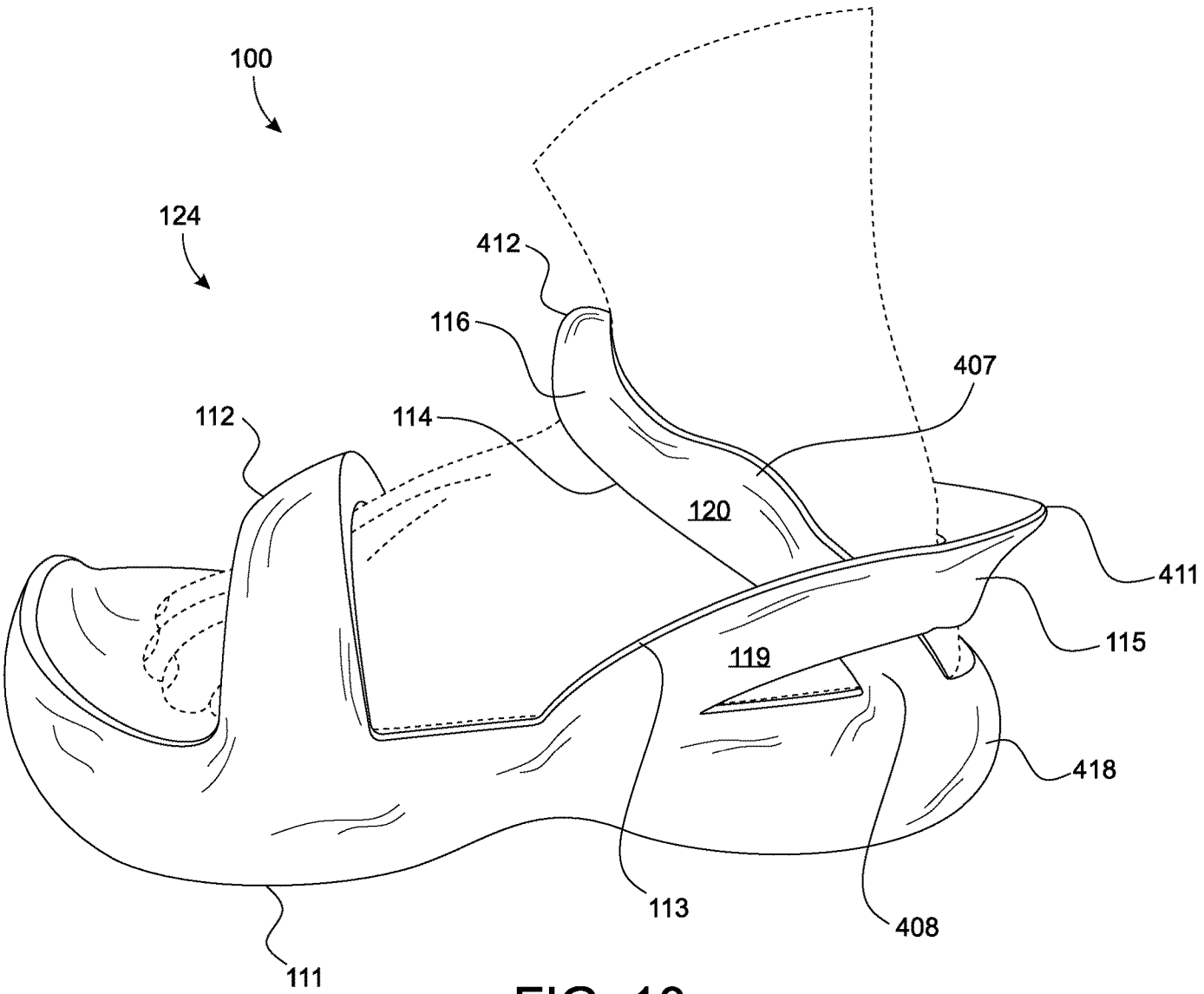
FIG. 10 presents a right side perspective view of the exemplary bimodal shoe of FIG. 4, where the shoe is positioned in the open first position, while in assembled form, apt for donning or doffing of the shoe, as exhibited by the image of a foot in process of being inserted or removed, in accordance with aspects of the present disclosure.

As seen in FIG. 10, the preferred embodiment of the shoe of FIG. 3 is presented in assembled form in the open first position 124, with a foot in the process of being donned or doffed.

Figure 11:
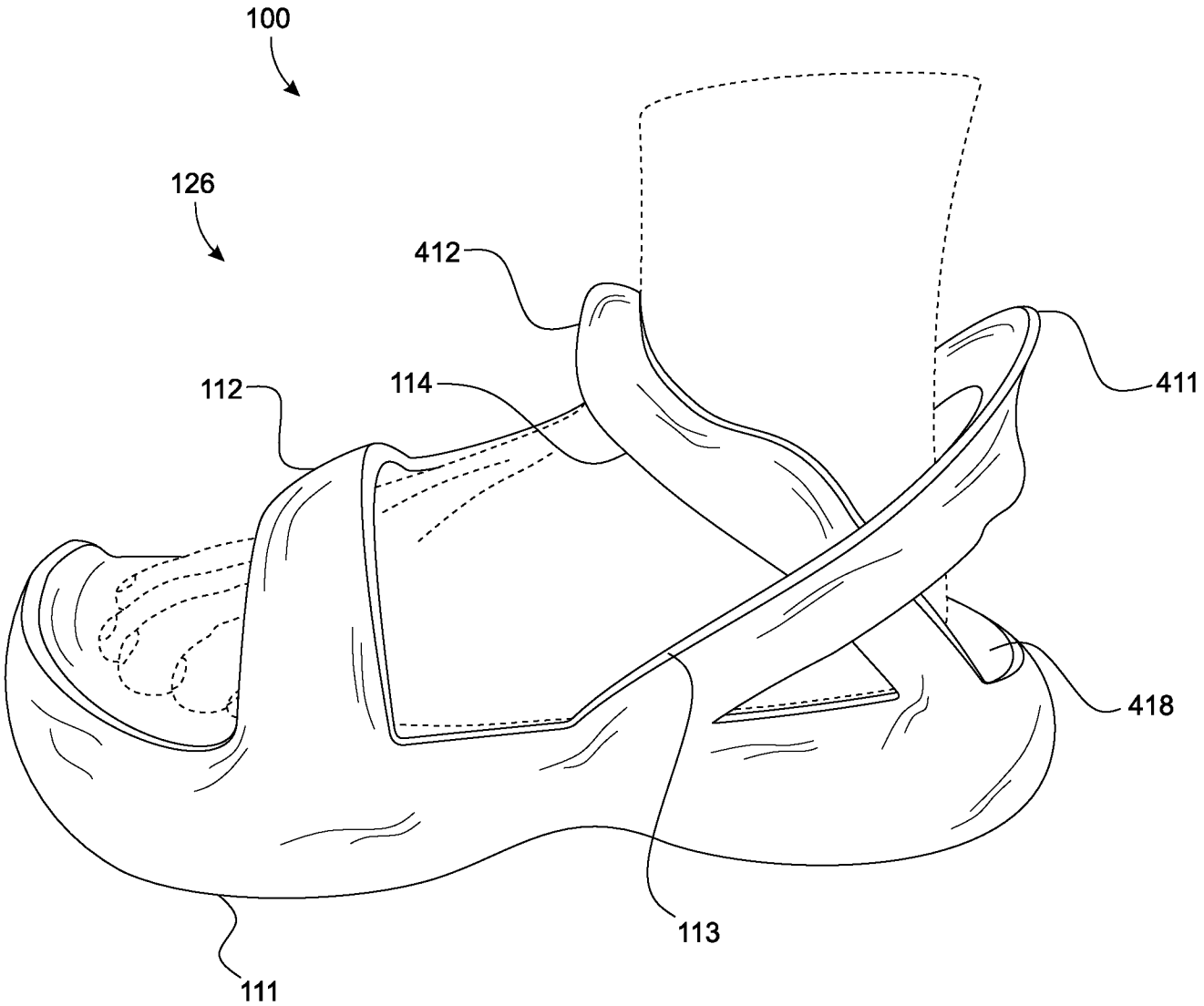
FIG. 11 presents a side perspective view of an exemplary bimodal shoe of FIG. 1, where the shoe is positioned in the closed second position, in assembled form, apt for securing a foot, as exhibited by the image of a secured foot, in accordance with aspects of the present disclosure.

As seen in FIG. 11, the preferred embodiment of the shoe of FIG. 3 is presented in the closed second position 126, with a secured foot.

It is understood that numerous parts of the shoe such as the shoe wall, sole, heel counter, top lines, quarter panel, tongue, midsole, or stitch seam made of material with or without flexible properties, will be deformed, pushed, pulled, tightened, stretched, constricted or otherwise change structure depending on the different states 124 or 126, and the plurality of positions between, and said shoe structures will aid in the securing or removal of the shoe to the foot, with the possible addition of strings, laces, straps, loops, belts, elastics, ribs, ropes, and other forms, and these variations of construction do not represent a unique utility, nor represent a distinction from the basic functionally derived from the bimodal shoe as described in this disclosure.

In conclusion, disclosed is a shoe that enables fast and easy placement and removal that is potentially hands-free, and presents in assembled form structural support and gripping of both the upper forefoot and the heel thus permitting running and rugged athletic activity. The shoe may be manufactured in a unibody form, with simple manual assembly into a flexed position with stored kinetic energy, without additional clasps or straps, for a functional bimodal shoe.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A shoe, comprising:

a sole structure comprising a footbed for a wearer's foot with an upper comprising a foot fastening mechanism at a toe box positioned to secure a forward portion of a foot; and a mid stadium arch in manufactured state at a middle point of the sole structure having a single, bendable, arched band with terminating ends and an apex, the ends cross the mid section of the sole and are anchored to the sides of the sole, at or below a plane of the footbed, the apex of the band representing an anatomically positioned heel notch with a slight concavity for securing the heel of the foot; and a stadium arch in manufactured state at a rear point of the sole structure having a single, bendable, arched band with terminating ends and an apex, the ends cross the rear section of the sole and are anchored to the sides of the sole, at or below a plane of the footbed, the apex of the band representing an anatomically positioned shoe collar with a slight concavity for securing the upper forefoot of the foot; and the mid stadium arch and the rear stadium arch are made of flexible, elastic material, being thus assembled and pulled in inverted form wherein the mid stadium arch is positioned rearward of the rear stadium arch, the stadium arches presenting a top line of a shoe collar and heel tab, being an opening cavity for inserting the foot; and having stored tension at the heel notch, and higher tension at its ends, the stored tension urging the heel notch being rotated upwardly and forwardly of a rear sole area of the sole; and having stored tension at the shoe collar, and higher tension at its ends, the stored tension urging the shoe collar being rotated upwardly and rearward of a mid sole area of the sole; and wherein the opening cavity for inserting of the foot expands to a first opening at a position with the heel notch of the mid stadium arch being rotated downward and rearward relative to the rear sole area of the sole, upon downward pressure from the foot, so that when the mid stadium arch is flexed in the first position the heel notch is positioned more rearward than the heel of the foot, tilted rearward and presenting a forward facing shoehorn shape so as to permit the foot to slide into the shoe, to facilitate entry and exit of the foot; and wherein the opening cavity for inserting of the foot expands to a first opening at a first position with the front shoe collar section of the rear stadium arch being rotated downward and forward relative to the mid sole area of the sole, upon forward pressure from the forefoot of the foot, so that when the rear stadium arch is flexed in the first position the shoe collar is positioned more forward than the cuneiform bone region of the foot, tilted forward and presenting a rearward facing shoe horn shape so as to permit the foot to slide into the shoe, to facilitate entry and exit of the foot; and wherein the opening cavity for inserting of the foot contracts to a second opening at a second position when the apex of the mid stadium arch is rotated upwardly and forwardly relative to the rear sole area of the sole, stored tension of the mid stadium arch returning the heel notch to the assembled second position, the heel notch anatomically positioned at the rear of the heel at an Achilles tendon region; and the second opening is smaller than the first opening, to secure the foot within the shoe; and wherein the opening cavity for inserting of the foot contracts to a second opening at a second position when the apex of the rear stadium arch is rotated upward and rearward relative to the mid sole area of the sole, stored tension of the rear stadium arch returning the shoe collar to the assembled second position, the shoe collar anatomically positioned at the top of the forefoot; and the second opening is smaller than the first opening, to secure the foot within the shoe.

2. The shoe of claim 1, wherein the mid stadium arch and the rear stadium arch are assembled in inverted fashion, the mid stadium arch passing over and rearward of the rear stadium arch.

3. The shoe of claim 2, wherein the rear stadium arch comprises outwardly curved "C" shape upper and lower blocking sections.

4. The shoe of claim 1, wherein the mid stadium arch and the rear stadium arch are assembled in inverted fashion, the mid stadium arch passing below and rearward of the rear stadium arch.

5. The shoe of claim 1, wherein the mid stadium arch and the rear stadium arches are fastened at to each other at the mid sections, the left side arm band of the mid stadium arch to the left side arm band of the rear stadium arch, and the right side arm band of the mid stadium arch to the right side arm band of the rear stadium arch.

6. The shoe of claim 1, wherein the mid stadium arch is anchored to the rear part of the sole below the heel tab in its assembled position with one of the group consisting of a connecting strap, string, cable, chain, rope, line, or a strap-like portion thereof anchored to the sole with mid stadium arch and the rear stadium arch a clasp, bolt, grommet, or other connecting device.

7. The shoe of claim 1, wherein the mid stadium arch is anchored to the opposite sides of the rear portion of the sole, rearward of the mid-sole, below the heel tab in its assembled position with mid stadium arch and the rear stadium arch connecting straps, strings, cables, chains, ropes, lines, or strap-like portions thereof anchored to the sole with mid stadium arch and the rear stadium arch clasps, bolts, grommets, or other connecting devices.

8. The shoe of claim 1, wherein the upper portion of the dual side arm bands of the rear stadium arch connecting the side arms to the shoe collar area are formed as outwardly curved "C" shape, inwardly curved "C" shaped, "Z" shaped, "S" shaped, "V" shaped, "L" shaped, or "O" shaped elongating sections of the side arm bands of each side below the shoe collar region, forming an elongating section.

9. The shoe of claim 1, wherein the rear stadium arch comprises upper blocking sections.

10. The shoe of claim 1, wherein the rear stadium arch comprises lower blocking sections.

* * * * *